US005588923A

United States Patent [19]

Schmidt et al.

[11] Patent Number: 5,588,923

[45] **Date of Patent: *Dec. 31, 1996**

[54] GOLF CLUB HEAD WITH ATTACHED SELECTED SWING WEIGHT COMPOSITE

[75] Inventors: Glenn H. Schmidt, Malibu; Richard C. Helmstetter, Carlsbad, both of Calif.

[73] Assignee: Callaway Golf Company, Carlsbad, Calif.

[ * ] Notice: The term of this patent shall not extend beyond the expiration date of Pat. No. 5,409,229.

[21] Appl. No.: 414,552

[22] Filed: Apr. 6, 1995

Related U.S. Application Data

[63] Continuation-in-part of Ser. No. 119,622, Sep. 13, 1993, Pat. No. 5,409,229, which is a continuation-in-part of Ser. No. 999,250, Jan. 19, 1993, Pat. No. 5,301,946, which is a continuation-in-part of Ser. No. 921,857, Aug. 5, 1992, Pat. No. 5,282,625.

[51] Int. Cl.[6] ..... A63B 53/04

[52] U.S. Cl. ..... 473/340; 473/329; 473/332; 473/324

[58] Field of Search ..... 273/167 H, 167 J

[56] References Cited

U.S. PATENT DOCUMENTS

| | | | |
|---|---|---|---|
| D. 228,355 | 9/1973 | Penna | 473/340 |
| D. 234,963 | 4/1975 | Hirata | 473/340 |
| D. 247,383 | 2/1978 | Adkins | 473/340 |
| D. 303,132 | 8/1989 | Muta | 473/340 |
| D. 321,920 | 11/1991 | Parente et al. | 473/340 |
| 1,854,548 | 4/1932 | Hunt | 473/340 |
| 1,980,408 | 11/1934 | Jansky | 473/340 |
| 1,993,928 | 3/1935 | Glover | 473/340 |
| 2,846,228 | 8/1958 | Reach | 473/340 |
| 3,068,011 | 12/1962 | Sano | 473/340 |
| 3,079,157 | 2/1963 | Turner | 473/340 |
| 3,841,641 | 10/1974 | Bennett | 473/340 |
| 3,847,399 | 11/1974 | Raymont | 473/340 |
| 3,863,982 | 2/1975 | Lezatte | 473/340 |
| 3,923,308 | 12/1975 | Mills | 473/340 |
| 3,967,826 | 7/1976 | Judice | 473/340 |
| 4,043,562 | 8/1977 | Shillington | 473/340 |
| 4,113,249 | 9/1978 | Beery | 473/340 |
| 4,199,144 | 4/1980 | Skelly | 473/340 |
| 4,355,808 | 10/1982 | Jernigan et al. | 473/340 |
| 4,398,965 | 8/1983 | Campau | 473/340 |
| 4,573,685 | 3/1986 | Young, IV et al. | 473/340 |
| 4,632,400 | 12/1986 | Boone | 473/340 |
| 4,653,756 | 3/1987 | Sato | 473/340 |
| 4,715,601 | 12/1987 | Lamanna | 473/340 |
| 4,740,345 | 4/1988 | Nagasaki et al. | 473/340 |
| 4,792,139 | 12/1988 | Nagasaki et al. | 473/340 |

(List continued on next page.)

FOREIGN PATENT DOCUMENTS

| | | | |
|---|---|---|---|
| 582366 | 4/1993 | European Pat. Off. | 473/340 |
| 608128 | 1/1994 | European Pat. Off. | 473/340 |
| 0642812A2 | 3/1996 | European Pat. Off. | 473/340 |
| 2680695 | 9/1993 | France | 473/340 |
| 53-15412 | 5/1978 | Japan | 473/340 |
| 37178 | 1/1991 | Japan | 473/340 |
| 371974 | 5/1932 | United Kingdom | 473/340 |
| 2165461 | 4/1986 | United Kingdom | 473/340 |
| WO9320904 | 10/1993 | WIPO | 473/340 |

OTHER PUBLICATIONS

Golf Digest Annual 1978, Feb., 1978, p. 22, "Reflex".
"Some of Our Best Friends are Hookers and Pushers", Golf World, Jan. 1974, p. 45.
"The Ounce That Coutns", Golf World, Jan. 24, 1975, pp. 46 and 47.
"Stroke–Savers", Golf Digest, Mar. 1988, pp. 82 and 83.
"FTD Iron by First Flight", Golf World, May 23, 1972, p. 10.

*Primary Examiner*—V. Millin
*Assistant Examiner*—Charles W. Anderson
*Attorney, Agent, or Firm*—William W. Haefliger

[57] ABSTRACT

In combination a golf club head having a front wall, the front wall having a rear side, and a composite adhered to the rear side, the composite including a selected swing weight adjusting intermediary layer, and a non-metallic rearwardly facing layer providing identification graphics which are rearwardly visible.

33 Claims, 2 Drawing Sheets

U.S. PATENT DOCUMENTS

| | | | |
|---|---|---|---|
| 4,798,383 | 1/1989 | Nagasaki et al. | 473/340 |
| 4,811,950 | 3/1989 | Kobayashi | 473/340 |
| 4,848,747 | 7/1989 | Fujimura et al. | 473/340 |
| 4,854,581 | 8/1989 | Long | 473/340 |
| 4,884,812 | 12/1989 | Nagasaki et al. | 473/340 |
| 4,913,435 | 4/1990 | Kobayashi | 473/340 |
| 4,928,972 | 5/1990 | Nakanishi et al. | 473/340 |
| 4,957,294 | 9/1990 | Long | 473/340 |
| 4,964,640 | 10/1990 | Nakanishi et al. | 473/340 |
| 4,995,609 | 2/1991 | Parente et al. | 473/340 |
| 5,026,056 | 6/1991 | McNally et al. | 473/340 |
| 5,046,733 | 9/1991 | Antonious | 473/340 |
| 5,067,711 | 11/1991 | Parente et al. | 473/340 |
| 5,082,279 | 1/1992 | Hull et al. | 473/340 |
| 5,118,562 | 6/1992 | Johnson et al. | 473/340 |
| 5,127,653 | 7/1992 | Nelson | 473/340 |
| 5,176,384 | 1/1993 | Sata et al. | 473/340 |
| 5,277,423 | 1/1994 | Artus | 473/340 |
| 5,282,625 | 2/1994 | Schmidt et al. | 473/340 |
| 5,290,036 | 3/1994 | Fenton et al. | 473/340 |
| 5,301,946 | 4/1994 | Schmidt et al. | 473/340 |
| 5,409,229 | 5/1995 | Schmidt et al. | 273/167 H |

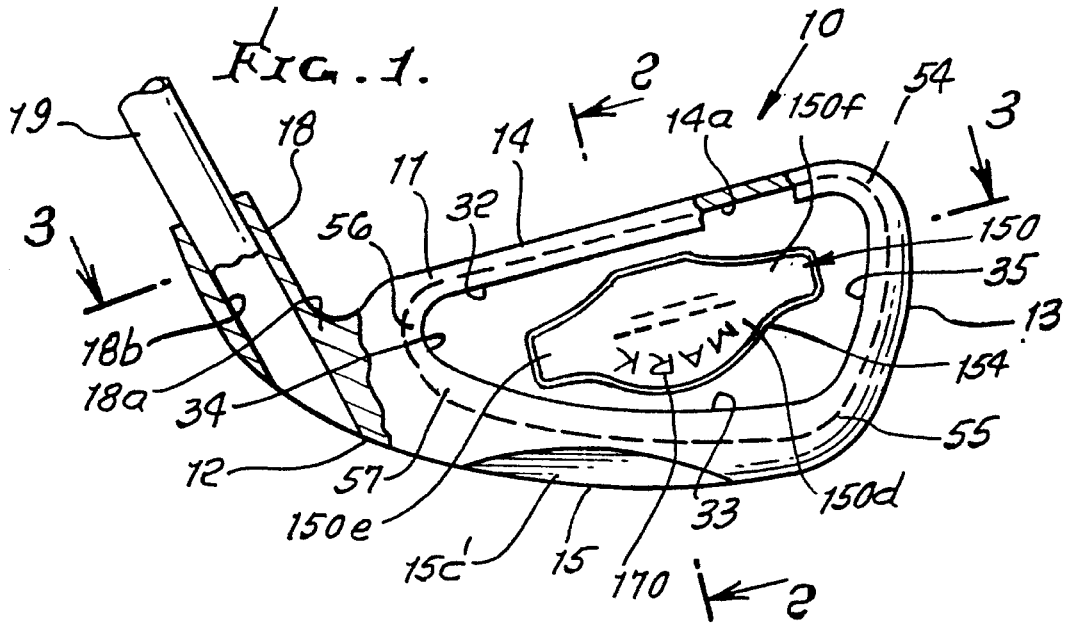
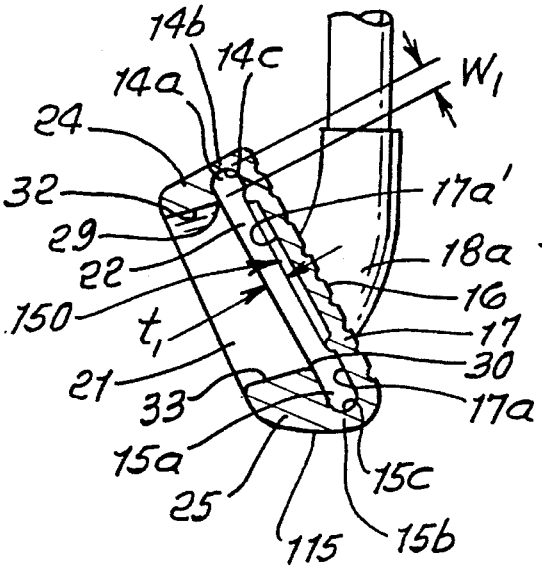
FIG. 2.
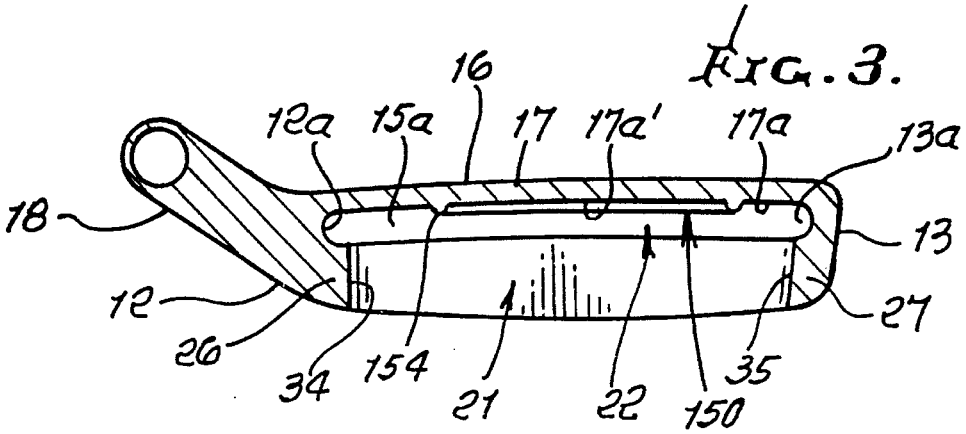
FIG. 3.

GOLF CLUB HEAD WITH ATTACHED SELECTED SWING WEIGHT COMPOSITE

BACKGROUND OF THE INVENTION

This application is a continuation-in-part of prior U.S. application Ser. No. 08/119,622 filed Sep. 13, 1993, U.S. Pat. No. 5,403,229, which is a continuation-in-part of prior U.S. application Ser. No. 07/999,250 filed Jan. 19, 1993, now U.S. Pat. No. 5,301,946, which is a continuation-in-part of prior U.S. application Ser. No. 07/921,857 filed Aug. 5, 1992, now U.S. Pat. No. 5,282,625.

This invention relates generally to golf clubs, and more particularly to golf club irons of improved construction, wherein structure is provided to enable ready swing weight adjustment, as during club manufacture or assembly.

During manufacture of a golf club iron, the club swing weight is typically adjusted, as for example near completion of manufacture. Typically, after the club shaft is attached to the head, the swing weight is determined, and is typically found to be less than a target swing weight, as by an amount $\Delta$, where $\Delta$ (usually in grams) varies for different clubs of the same head number. Therefore, there is need to provide additional weight, in varying incremental amounts, such as $\Delta_1, \Delta_2, \Delta_3$ etc. for a succession of clubs, in order to bring them up to, or very close to, target swing weight.

In the past, small rigid metal plates have been attached to the rear sides of the front walls of iron heads to attenuate audible vibration and to add weight, but such plates can and do become detached, as after repeated golf ball-striking use of the club.

There is need for efficient, reliable method, and means, to effect head swing weight adjustment, which does not require the use of rigid plate attachment to golf club iron heads.

SUMMARY OF THE INVENTION

It is a major object of the invention to provide swing weight adjustment method and means meeting the need referred to above, as well as providing additional unusual advantages, as will appear.

Basically, the invention is embodied in a combination that includes:

a) a golf club head having a front wall, the front wall having a rear side, b) and a composite adhered to the rear side, the composite including:

i) a selected swing weight adjusting intermediary layer, and ii) a non-metallic rearwardly facing layer that may provide identification graphics, which are rearwardly visible.

As will appear, the swing weight adjusting intermediary layer may comprise a selected weight carrying flexible layer such as a tape; or the weight adjusting intermediary layer may comprise metallic particles dispersed in or on flexible adhering material. The latter material is typically employed to bond the composite to the back side of the head front wall. Different weightings of such material in different composites enables selection of a particular weighted composite for adherence to an iron, to provide desired target swing weight.

It is another object to provide the rearwardly facing layer, on which graphics are provided, in the form of a MYLAR sheet supporting such viewable identification graphics. The latter may for example be in the form of a medallion. A transparent protective plastic layer may be provided to overlie the MYLAR sheet as will appear.

The fact that the composite is readily flexible prior to its adherence to the club wall facilitates such adherence under application pressure, as will appear.

It is a further object of the invention to provide a set of irons which have been swing weighted in accordance with selection of different adhering composites, as referred to.

It is yet another object of the invention to provide an improved iron head construction meeting the above needs by carrying the described composite, and also to provide for club head increased twist resistance. The iron head may be advantageously configured to define two intersecting recesses rearwardly of the head front wall, and bounded by head metallic extents projecting proximate peripheral regions of the head face defining front wall, and via web means adjacent the head front wall periphery. For example, the head may include:

a) a body defining a forwardly extending main recess located rearwardly of the front wall, b) the body also defining an undercut recess located directly rearwardly of the front wall and extending outwardly from the main recess toward at least one of the following:

i) said top wall ii) said bottom wall iii) said toe iv) said heel, c) together with composite structure attached to the rear side of the front wall, and located forwardly of the main recess, and spaced from the undercut recess, for providing swing weight adjustment.

As will be seen, the swing weight adjusting structure may have the composite construction as referred to above, and the front wall rear side may be additionally locally recessed to receive and confine the composite. Further, the head undercut recess may extend outwardly from its intersection with the main recess and away from the composite periphery, and toward one or both of the top and bottom walls, and may also extend toward the toe and heel, whereby the undercut recess may then bound the main recess. This construction also facilitates provision of an enlarged sweet spot, at the head front wall forward side forwardly of the swing weight adjusting composite and of peripheral extents of the head.

Typically, the metal of the head may have reduced thickness to form a web or webs directly rearwardly of the front wall periphery, due to the provision of the undercut recess, as referred to. Thus, the undercut recess typically extends upwardly to points along the head length rearwardly of the top of the front wall front face, and downwardly to points along the head length rearwardly of the bottom of the front wall front face. This also enables reallocation of some metal to project rearwardly from the looping recess, enhancing head peripheral weighting for anti-twist effect; and tendency of the front wall to create sound may be reduced due to provision of the swing weight adjusting composite.

Another objective is to provide an undercut recess, as referred to, which extends in a loop that lies generally parallel to the inclined front face of the iron and extends about the inclined swing weight adjusting composite. Such inclination varies with the number of the iron, designating different front face inclinations, as for example 1 to 9 irons and wedges.

Yet another object is to provide a set of irons, each iron incorporating the unusually advantageous structure, as referred to.

These and other objects and advantages of the invention, as well as the details of illustrative embodiments, will be more fully understood from the following specification and drawings, in which:

DRAWING DESCRIPTION

FIG. 1 is a rear elevation of the head of a iron of a golf club set incorporating the invention;

FIG. 2 is a section taken on lines 2—2 of FIG. 1;

FIG. 3 is a section taken on lines 3—3 of FIG. 1;

DETAILED DESCRIPTION

Figure 4:
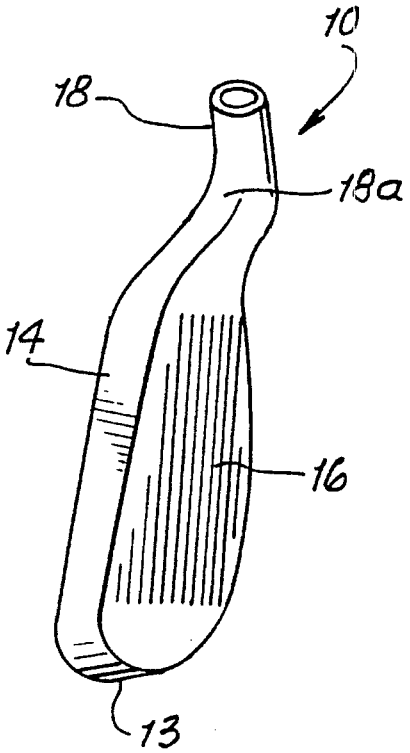
FIG. 4 is a top plan view of the FIG. 1 head.
Figure 5:
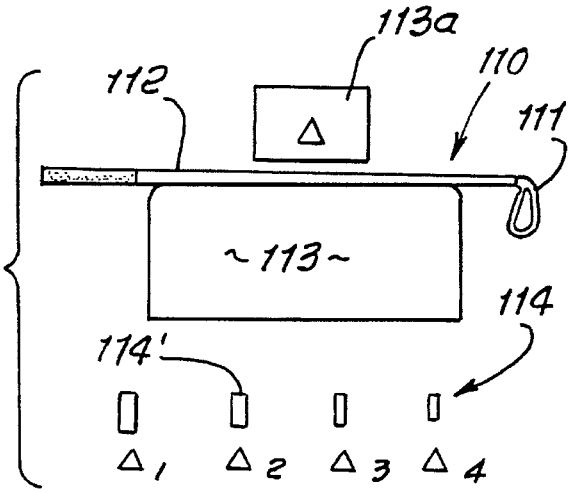
FIG. 5 is a view showing swing weight determination.

Referring first to FIG. 5, a golf club, as for example a golf iron 110 has a head 111 and a shaft 112. The club is shown being subjected to swing weight determination, as by apparatus 113, as is known. The swing weight output display 113*a* may indicate the weight addition Δ needed to bring the club as manufactured up to target swing weight. The apparatus operator then selects an appropriate swing weight package or composite from the group indicated at 114, for application to the club head. The packages at 114 have different weights, typically in grams as indicated by the symbols $\Delta_1$,$\Delta_2$,$\Delta_3$, and $\Delta_4$, and the one selected is that which most closely matches the required addition weight amount Δ. Merely as illustrative, the composites corresponding to $\Delta_1$,$\Delta_2$,$\Delta_3$, and $\Delta_4$ may have weights of 2, 4, 6 and 8 grams, respectively.

Figure 6:
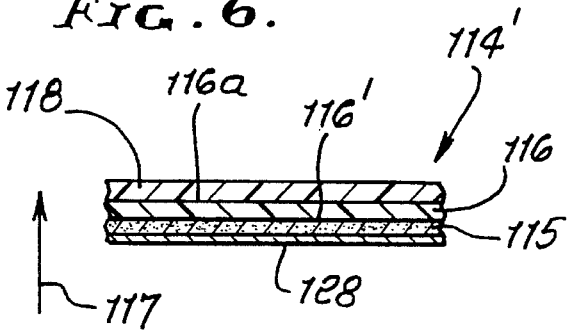
FIG. 6 is an enlarged, fragmentary section taken through a swing weight adjusting composite.

FIG. 6 is a cross section taken through a flexible package or composite 114' selected from the like appearing composites in group 114. Basically, the composite itself includes a swing weight adjusting flexible layer 115, and a non-metallic flexible layer 116 adherent at 116' to layer 115. Layer 116 typically carries graphics such as indicia at its side 116*a* which in use face rearwardly, i.e. in the direction of arrow 117 in FIGS. 6 and 8, so that the graphics are visible to the eye 130 of the club user indicated in FIG. 8. An additional flexible transparent plastic layer 118 may be applied over layer 116, to protect the graphics from marring or other damage, as could be inflicted by impact with other golf club heads such as irons carried in a golf bag.

Layer 116 may consist for example of a thin flexible transparent MYLAR sheet, interposed between 115 and 118; and its side facing 115 may be lightly silvered to a few microns thickness to provide a visible background to the graphics applied at 116*a*. The graphics may have or present the form of a medallion or trademark, providing club identity with the manufacturer.

Figure 8:
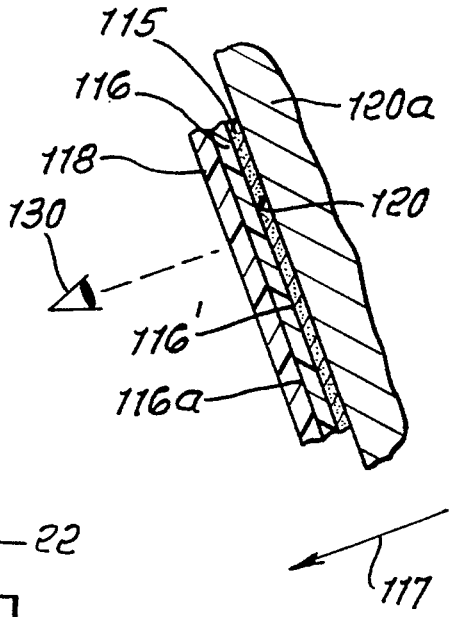
FIG. 8 is a still further enlarged, vertical section taken through a swing weight adjusting composite, as used on a golf club iron head.
Figure 7:
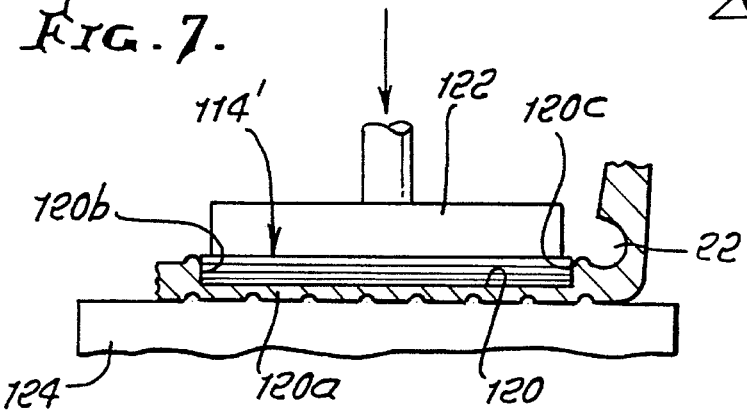
FIG. 7 is a view showing application of a composite to a golf club head.

Flexible layer 115 consists of strongly adhesive semi-solid material which lies intermediate layer 116 and the golf club head surface 120 seen in FIGS. 7 and 8. Accordingly, it attaches the composite or sandwich configuration package to the golf club surface 120, which may for example comprise the rear surface of an iron front wall, indicated at 120*a* in FIG. 8.

Enhanced adhesive attachment may be effected by high pressure application to the composite 114'. See the plunger 122 in FIG. 7 pressing downwardly against 114', urging it against surface 120 of metal wall 120*a* supported on a platen 124. Wall 120*a* is recessed as shown to provide peripheral confinement for the composite, as at 120*b* and 120*c*. Attachment of the composite to the wall 120*a* may be further aided or enhanced by provision of a thin coating of urethane plastic material on and strongly adhering or bonding to wall 120*a*, curing that coating, and abrasively roughening the coating. The flexible adhesive layer 115 is thereby displaced against the roughened surface of the coating to lock as by bonding to interstices therein. Heat may be applied to enhance bonding. Overall bending flexibility of the package 114' promotes such locking adherence thereby preventing delamination, in use.

It is a feature of the invention that the intermediary layer 115 has or provides for selected swing weight, whereby the composites in the group 114 have different weights $\Delta_1$–$\Delta_4$ for selective swing weight adjustment of different golf clubs to which they are selectively applied, i.e. so that all clubs meet target swing weight. For this purpose, the adhesive material may carry particles, such as dispersed heavy metal particles, and in such manner as to maintain layer flexibility. Typical particles include lead and tungsten. The layer 115 itself may take the form of an adhesive tape, or adhesive bearing tape, the latter being flexible and bearing dispersed weight.

FIG. 6 shows a protective MYLAR layer or film 128 on adhesive layer 115, and which may be peeled off just prior to pressure application of the adhesive layer 115 to the club head surface.

The adhesive material of layer 115 may consist of acrylic.

Layer 118 may consist of urethane.

Reference will next be made to a specific application of the composite or package as shown in FIGS. 6–8. FIGS. 1–3 illustrate a golf club head 10, in the form of a #6 iron of a set, having a body 11 defining a heel 12, toe 13, top wall 14, and sole 15. The rear of the sole is beveled at 15*c'* as shown. The body also defines an upwardly and rearwardly inclined front face 16 at the frontal side of an associated front wall 17. A hosel is shown at 18 and integrally joins the head via offset 18*a*; and a shaft 19 extends into a through bore 18*b* in the hosel as shown, and is anchored therein in a suitable manner, as for example by adhesive or mechanically. See for example U.S. Pat. No. 5,042,806, incorporated herein by reference. The head and hosel may consist of a one-piece, metallic steel casting, other metals and alloys being usable.

The body defines two intersecting recesses related to rearwardly elongated body projections, typically extending rearwardly, as will be described, irrespective of the head front face angularity. The two recesses include a forwardly and rearwardly extending main recess 21, and an undercut recess 22 located directly rearwardly of the front wall and extending outwardly from the forwardmost extent of the main recess 21, toward at least one of the following:

i) the top wall
ii) the bottom wall
iii) the toe
iv) the heel,

Typically, the undercut recess portions 14*a* and 15*a*, associated with walls 14 and 15, are elongated directionally between the toe and heel, over the major length of the head, thereby enhancing certain benefits which include metal redistribution toward the upper and lower peripheries of the head, and projecting rearwardly at 24 and 25, for resisting twist of the head during stroking and ball impact. Such metal rearward redistribution, i.e., lengthening in a rearward and outward (enlarging effect) direction, as at 24 and 25, rearwardly of undercuts 14*a* and 15*a*, is believed to achieve momentum transfer from the metal portions 24 and 25, to the front wall and front face 16, in such manner as to maintain a greater time interval of front face contact with the ball during stroking, for better ball control.

This effect may be further enhanced by the provision of at least one elongated slit extending generally parallel to the front face 16 and spaced rearwardly from that face 16, to intersect undercut 14*a* and the upper surface of 24.

Note that such momentum transfer, visualized in the form of forward waves, is required to pass around and through the reduced thickness (i.e. web) forward portions 14*b* and 15*b* of the rearwardly projecting portions 24 and 25, and at the corners 54 and 55, as well as at regions 56 and 57 near the heel; and momentum or inertial travel through such restricted, narrowed regions 14*b* and 15*b*, and at 54–57, is facilitated by the outwardly concave curvature at 14*c* and 15*c*, or other similar thickness narrowing shape, bounding the outermost extents of the undercuts 14*a* and 15*a*. Enhanced performance is thereby achieved in terms of better ball stroking and directional control.

The undercut recess portions 12*a* and 13*a*, associated with the heel and toe, and associated metal redistribution rearwardly and functionally outwardly (i.e., enlarging effect) from those undercuts, at corners 54–57, contribute to and add to the same effects as described above for the undercut recess portions 14*a* and 15*a* at those corners. The undercut recess projects outwardly to an extent $w_1$ (which may vary, as shown); however, the front-to-rear thickness $t_1$ of the undercut recess is approximately as follows:

$$0.5t_1<w_1<1.5t_1$$

The radii of the circular curvatures at 14*c* and 15*c* are typically between 0.150 and 0.160 inches for #1 through #7 irons; between 0.210 and 0.230 for #8 and #9 irons; and between 0.300 and 0.320 for a pitching wedge; however, these dimensions can vary somewhat.

In this regard, the rearward projections extending rearwardly from the toe and heel undercuts are elongated in relation to their thickness dimensions, showing that metal has been redistributed to those projections to enhance the effects described and without increasing the overall vertical dimension of the head.

Note also that the dimension of the recess 21, between internal corners 29 and 30, is typically substantially greater than three times the depth dimension of each of the undercut recess portions 14*a* and 15*a*, in an outward direction from those corners. The inner sides 32 and 33 of the projections 24 and 25 are substantially flat in a forward to rearward direction; however, they define a loop in combination with the corresponding inner and curved sides 34 and 35 of the projections 26 and 27, that loop subtending the major aerial extent of the front face, including a "sweet spot". Correspondingly, all undercut sections 14*a* and 15*a*, 12*a* and 15*a*, also define, preferably, a loop.

It will be understood that #1–5 and #7–9 irons have the same construction, but with associated changing front face inclinations, as in a set of such irons. Accordingly, each iron of the set may have the construction as described.

Referring now to FIGS. 1, 2, and 3, composite means 150 is provided on the front wall 17 and located forwardly of the main recess 21 for attaining adjusted desired swing weight of the club.

Such composite means is typically attached to the rear side 17*a* of the front wall and is openly exposed to both recesses 21 and 22, the undercut recess extending about and spaced from the composite means indicated at 150. Composite 150 has the layered construction as described in reference to composite 114' of FIGS. 6 and 8 above. Rear side 17*a* can have shallow curvature as seen in FIG. 3, the flexibility of the composite enhancing its conformation to side 17*a*.

The front wall rear side is shown as forming a shallow re-entrant recess 17*a'* receiving and peripherally confining the composite. See also ridge 154 on the front wall rear side adjacent the composite peripheral configuration. The latter includes planar center portion 150*d*, and two planar wings 150*e* and 150*f* projecting in opposite directions, i.e., toward the heel and toe, respectively. The entirety of the composite 150 is effectively in or adjacent the plane of the rear side of the front wall of the head. The rearward projection of composite 150 defines an area between 25% and 75% of the cross sectional area of the recess 21, in planes parallel to the plane of the thin plate. Also, the composite area is between 20% and 65% of the area of the rear side of the front plate subtended by both recesses 21 and 22.

Graphics on the composite are visible via recess 21, as at 170 as seen in FIG. 1, and may take the form of indicia.

We claim:

1. In combination:

a) a golf club head having a front wall, said front wall having a rear side, b) and a composite adhered to said rear side, said composite including:

i) a selected swing weight adjusting intermediary layer, and ii) a non-metallic rearwardly facing layer providing identification graphics which are rearwardly visible.

2. The combination of claim 1 wherein said intermediary layer is a selected weight carrying flexible tape.

3. The combination of claim 2 wherein said rearwardly facing layer is thin and consists of flexible plastic material.

4. The combination of claim 1 wherein said composite includes a protective transparent layer rearwardly overlying said graphics.

5. The combination of claim 1 wherein said graphics define a medallion.

6. The golf club head of claim 5 wherein said composite structure has an enlarged central portion and two wings projecting oppositely generally toward the toe and heel respectively of the head.

7. The combination of claim 1 wherein said rearwardly facing layer providing said graphics includes a Mylar sheet.

8. The combination of claim 1 wherein said swing weight adjusting intermediary layer includes flexible adhesive material.

9. The combination of claim 8 wherein said swing weight adjusting intermediary layer includes metallic particles dispersed in or on said flexible adhesive material.

10. The combination of claim 1 wherein said golf club head is a golf iron head.

11. The golf club head of claim 1 wherein said undercut recess extends about said composite means.

12. The combination of claim 1 wherein said rear side of the front wall is defined by a thin plastic layer having interstices to which said intermediary layer becomes bonded.

13. A golf club head having a body defining a heel, toe, top wall, sole defining a bottom wall, and a front wall defining an upwardly and rearwardly inclined front face, and comprising a) said body defining a forwardly extending main recess located rearwardly of said front wall, b) and said body also defining an undercut recess located directly rearwardly of said front wall and extending outwardly from said main recess toward at least one of the following:

i) said top wall ii) said bottom wall iii) said toe iv) said heel, c) and composite structure on the rear side of said front wall and located forwardly of said main recess for providing swing weight adjustment.

14. The club head of claim 13 wherein said composite structure is openly exposed to said recesses.

15. The golf club head of claim 13 wherein said composite structure has a periphery, and said front wall has a shallow re-entrant recess at said rear side receiving said composite structure, closely adjacent said periphery.

16. The golf club head of claim 13 wherein said undercut recess extends outwardly from said main recess and adjacent said front wall in spaced relation to said composite structure toward at least two of the following:

i) said top wall ii) said bottom wall iii) said toe iv) said heel.

17. The club head of claim 13 wherein said undercut recess extends outwardly from said main recess and adjacent said front wall in spaced relation to said composite structure toward at least three of the following:

i) said top wall ii) said bottom wall iii) said toe iv) said heel.

18. The golf club head of claim 13 wherein said undercut recess extends outwardly from said main recess and in spaced relation to said composite structure toward all four of the following:

i) said top wall ii) said bottom wall iii) said toe iv) said heel.

19. The golf club head of claim 18 wherein said undercut recess extends in a loop that is generally parallel to the inclined front face.

20. The golf club head of claim 18 wherein said undercut recess extends outwardly toward said top wall and toward said bottom wall, the depth of the undercut recess toward said top wall being lesser than the depth of said undercut recess toward said bottom wall.

21. The golf club head of claim 13 wherein said head has rearward projection with upward thickening between said bottom wall and said main recess.

22. The golf club head of claim 21 wherein said head has rearward projection with downward thickening between said top wall and said main recess.

23. The golf club head of claim 21 wherein said body is a one-piece casting, and defines an iron golf club head.

24. The golf club head of claim 21 wherein said rearward projection from the undercut recess has substantially greater overall rearward dimension than vertical thickness dimension.

25. The golf club head of claim 13 wherein said head has rearward projection with downward thickening between said top wall and said main recess.

26. The golf club head of claim 25 wherein said rearward projection from the undercut recess has substantially greater overall rearward dimension than vertical thickness dimension.

27. The golf club head of claim 13 wherein said body is metallic.

28. The golf club head of claim 13 wherein said body consists of a metallic casting.

29. The golf club head of claim 13 wherein said undercut recess projects outwardly to an extent $w_1$, and has front to rear thickness $t_1$, where $0.5t_1<w_1<1.5t_1$.

30. The golf club head of claim 13 including indicia on the composite structure and facing said main recess.

31. For combination with a golf club head having a front wall, said front wall having a rear side, the improvement comprising a composite adapted to strongly adhere to said rear side, said composite including:

i) a selected swing weight adjusting intermediary layer, and ii) a non-metallic rearwardly facing layer providing identification graphics which are rearwardly visible.

32. The improvement of claim 31 wherein said graphics define a medallion.

33. The improvement of claim 31 wherein said swing weight adjusting intermediary layer includes metallic particles dispersed in or on said flexible adhesive material.

* * * * *